United States Patent [19]

Fujii et al.

[11] Patent Number: 4,539,543

[45] Date of Patent: Sep. 3, 1985

[54] CORE STRUCTURE FOR AN ELECTROMAGNETIC RELAY

[75] Inventors: Kunishisa Fujii, Saku; Kosei Yoshino, Komoro; Masami Nakazawa, Saku, all of Japan

[73] Assignee: Takamisawa Electric Co., Ltd., Tokyo, Japan

[21] Appl. No.: 635,684

[22] Filed: Jul. 30, 1984

[30] Foreign Application Priority Data

Jul. 28, 1983 [JP] Japan ..... 58-136797

[51] Int. Cl.[3] ..... H01F 7/08

[52] U.S. Cl. ..... 335/281; 335/276

[58] Field of Search ..... 335/270, 274, 276, 281, 335/128

[56] References Cited

U.S. PATENT DOCUMENTS

| | | | |
|---|---|---|---|
| 3,005,071 | 10/1961 | Brunicardi | 335/281 |
| 3,098,135 | 7/1963 | Farmer | 335/276 X |
| 3,158,712 | 11/1964 | De Fligue | 335/276 X |

*Primary Examiner*—George Harris

*Attorney, Agent, or Firm*—Armstrong, Nikaido, Marmelstein & Kubovcik

[57] ABSTRACT

An electromagnetic relay comprising a bobbin on which a winding is wound, a base block on which an armature and contact elements are mounted, an approximately U-shaped magnetic pole piece, and an approximately U-shaped magnetic yoke piece. The long tongues of the magnetic pole piece and the magnetic yoke piece are inserted into the bobbin, while the short tongues of the magnetic pole piece and the magnetic yoke piece are inserted with a gap into the base block.

5 Claims, 12 Drawing Figures

CORE STRUCTURE FOR AN ELECTROMAGNETIC RELAY

BACKGROUND OF THE INVENTION

1. Field of the Invention

The present invention relates to an electromagnetic relay in which elements such as contact elements and an electromagnet element can be easily and precisely combined.

2. Description of the Prior Art

A prior art electromagnetic relay comprises a bobbin on which a winding is wound, a base block on which stationary contact springs are mounted, a yoke, a spring-type armature on which a movable contact spring is mounted, and the like. In this case, an iron core is inserted into a through hole of the base block, a through hole of the bobbin, and a through hole of the yoke, and subsequently, such elements are combined by rivetting the edge of the iron core at the yoke. Then the spring-type armature having the movable contact spring is mounted on the yoke.

In the above-mentioned prior art, however, it is difficult to precisely maintain the positional relationship between the spring-type armature and the iron core, and accordingly, it is difficult to precisely maintain the positional relationship between the movable contact spring and the stationary contact springs. As a result, in order to maintain the high reliability of the relay and improve the lifetime period thereof, it is necessary to maintain the contact force of the contact springs by increasing the driving power of the winding, and it is also necessary to provide additional steps for adjusting the above-mentioned positional relationship.

SUMMARY OF THE INVENTION

It is an object of the present invention to provide an electromagnetic relay having a high reliability and a long lifetime period without increasing the driving power of the winding and without providing additional steps for the positional relationships between the contact elements. According to the present invention, an electromagnetic relay comprising a bobbin on which a winding is wound is provided with a base block on which an armature and contact elements are mounted, an approximately U-shaped magnetic pole piece, and an approximately U-shaped magnetic yoke. The long tongues of the magnetic pole piece and the magnetic yoke are inserted into the bobbin, while the short tongues of the magnetic pole piece and the magnetic yoke are inserted with a gap into the base block.

BRIEF DESCRIPTION OF THE DRAWINGS

The present invention will be more clearly understood from the description as set forth below when compared with the prior art and with reference to the accompanying drawings, wherein.

DESCRIPTION OF THE PREFERRED EMBODIMENT

Figure 1:
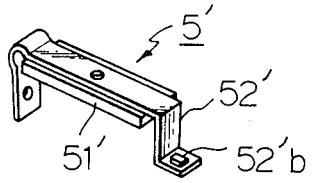
Fig. 1 PRIOR ART
FIG. 1 is an exploded, perspective view of a prior art electromagnetic relay.
Figure 1:
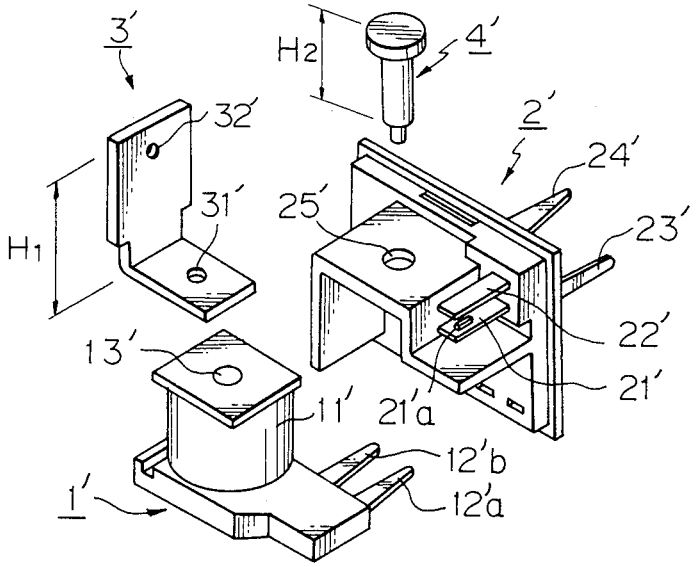
Fig. 1 PRIOR ART

In FIG. 1, which illustrates a prior art electromagnetic relay, reference numeral 1' designates a bobbin wound by a winding 11' which is connected to winding terminals 12'*a* and 12'*b*. A hollow 13' is formed in the bobbin 1 for penetrating an iron core 4' therethrough. Reference numeral 2' designates a base block, which comprises a stationary contact spring 21' having a make stationary contact 21'*a* thereon, and a stationary contact spring 22' having a break stationary contact 22'*a* (see FIGS. 4A and 4B). The stationary contact springs 21' and 22' are connected to terminals 23' and 24', respectively. Also formed in the base block 2' is a hollow 25' for penetrating the iron core 4' therethrough. Reference 3' designates a magnetic yoke. A hollow 31' is provided in the magnetic yoke 3' for penetrating the iron core 4' therethrough. A spring-type armature means 5' is also provided at the magnetic yoke 3' for mounting thereon. The armature means 5' comprises an armature 51' and an L-shaped hinge spring 52' which has two movable contacts 52'*a* and 52'*b* (see FIGS. 4A and 4B).

Figure 2:
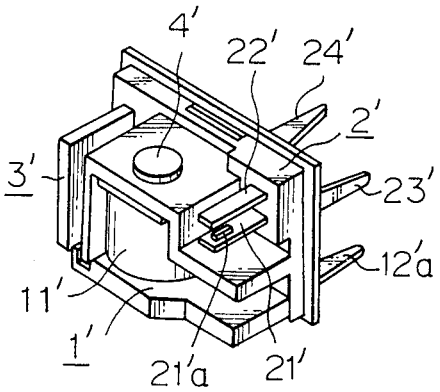
Fig. 2 PRIOR ART
FIG. 2 is a perspective view of the assembled relay of FIG. 1 with the spring-type armature removed.

Referring to FIG. 2, the bobbin 1', the base block 2', and the magnetic yoke 3' are assembled by penetrating the iron core 4' into the hollow 25' of the base block 2', the hollow 13' of the bobbin 1', and the hollow 31' of the magnetic yoke 3'. The end of the iron core 4' is then rivetted onto the magnetic yoke 3'.

Figure 3:
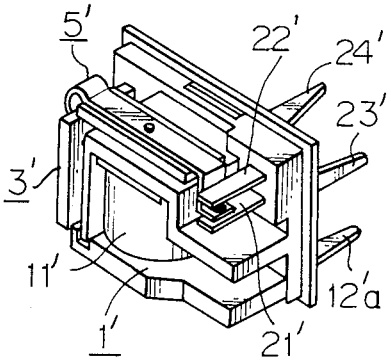
Fig. 3 PRIOR ART
FIG. 3 is a perspective view of the completely assembled relay of FIG. 1.
Figure 4A:
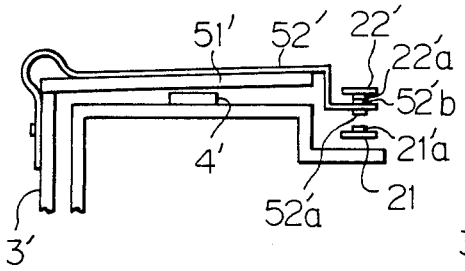
Fig. 4A PRIOR ART
FIGS. 4A and 4B are partial elevation views of the relay of FIG. 1 for explaining the operation thereof.
Figure 4B:
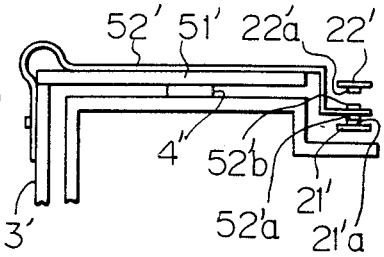
Fig. 4B PRIOR ART

Finally, as shown in FIG. 3, the spring-type armature means 5' is mounted by rivetting at the hole 32' of the magnetic yoke 3', thereby completing an electromagnetic relay. The operation of the assembled relay of FIG. 3 will be explained with reference to FIGS. 4A and 4B. As shown in FIG. 4A, when the winding 11' is not energized, the contact 52'*b* of the armature means 5' is in contact with the break stationary contact 22'*a* of the contact spring 22'. Contrary to this, when the winding 11' is energized, the contact 52'*a* of the armature means 5' is in contact with the make stationary contact 21'*a* of the contact spring 21'. In this case, the armature 51' of the armature means 5' is also in contact with the head of the iron core 4'. Therefore, it is important to precisely maintain the positional relationship between the armature means 5' and the iron core 4', i.e., precisely maintain the positional relationship between the contacts 21'*a*, 22'*a*, 52'*a*, and 52'*b*.

In the above-mentioned prior art, however, the assembling of the relay is carried out by rivetting the end of the iron core 4' to the magnetic yoke 3', so that the dimension H1 of the magnetic yoke 3' and the dimension H2 of the iron core 4' (see FIG. 1) are fluctuated due to the rivetting, thereby making it difficult to precisely maintain the above-mentioned positional relationship. As a result, in order to maintain the high reliability of the relay and improve the life-time period thereof, the driving power of the winding 11' has to be increased, which increases the power dissipation. Further, additional steps become necessary for adjusting the above-mentioned positional relationship.

Figure 5:
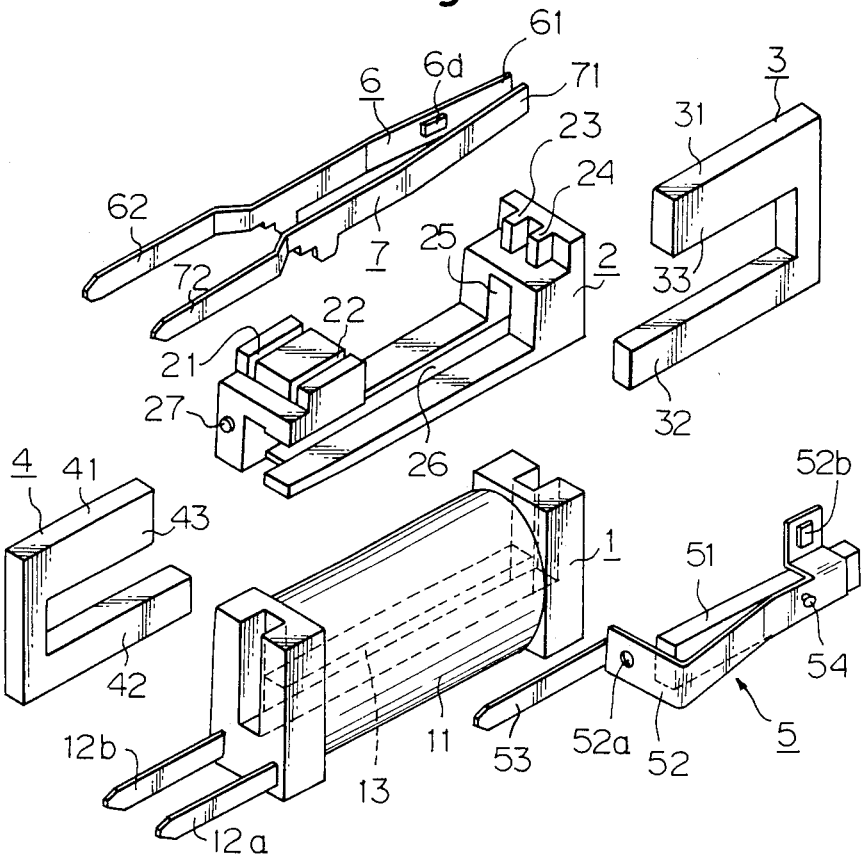
FIG. 5 is an exploded, perspective view of an embodiment of the electromagnetic relay according to the present invention.

In FIG. 5, which is an exploded perspective view of an embodiment of the present invention, reference numeral 1 designates a molded bobbin wound by a winding 11 which is connected to winding terminals 12*a* and 12*b*. Reference numeral 2 designates a molded base block, and 3 and 4 designate a magnetic pole piece and a magnetic yoke piece, respectively. Reference numeral 5 designates a spring-type armature means.

A make stationary contact spring 6 having a make stationary contact 6*a* and a break stationary contact spring 7 having a break stationary contact 7*a* (see FIG. 6B) are pressed and fixed into the grooves 21 and 22 of the base block 2. Thus, when the stationary contact springs 6 and 7 are incorporated into the base block 2, edges 61 and 71 of the springs 6 and 7 contact the protrusions 23 and 24, respectively, of the base block 2. In this case, terminal portions 62 and 72 of the stationary contact springs 6 and 7 are located outside of the base block 2.

The magnetic pole piece 3 and the magnetic yoke piece 4 are approximately U-shaped. The short tongues 31 and 41 of the magnetic pole piece 3 and the magnetic yoke piece 4 are inserted into a central hole 25 along the groove 26 of the base block 2, so that the short tongues 31 and 41 face each other with a gap. Simultaneously, the long tongues 32 and 42 of the magnetic pole piece 3 and the magnetic yoke piece 4 are inserted into the central hole 13 of the bobbin 1. In this case, the two long tongues 32 and 42 are in contact with each other, as indicated by E in FIG. 6A. As a result, the bobbin 1 and the base block 2 are combined.

The spring-type armature means 5 comprises an armature 51, an L-shape hinge spring 52 having a movable contact 52*a* and 52*b* (see FIG. 6A), and a terminal 53 connected to the spring 52. The hinge spring 52 is fixed to the armature 51 by rivetting or melting the protrusion 54. A hole 52*a* provided in the hinge spring 52 is fitted to a protrusion 27 of the base block 2, and the protrusion 27 is rivetted to firmly combine the spring-type armature means 5 with the base block 2. However, the spring-type armature means 5 and the base block 2 can be combined by pressure, adhering means, and the like.

Figure 6B:
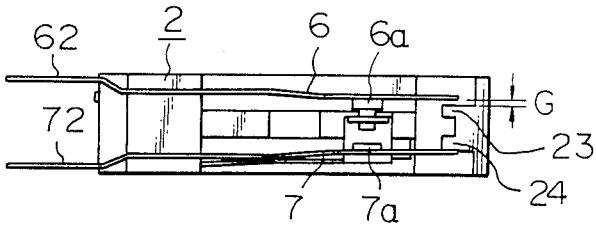
FIG. 6B is a plan view of the relay of FIG. 6A.
Figure 6A:
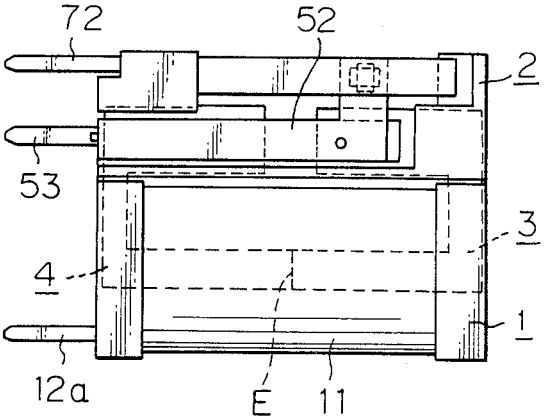
FIG. 6A is an elevation view of the assembled relay of FIG. 5.
Figure 6C:
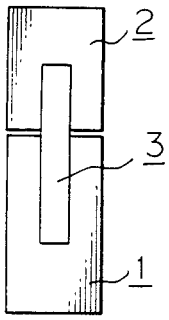
FIG. 6C is a right-side view of the relay of FIG. 6A.

An assembled view of the relay of FIG. 5 is illustrated in FIGS. 6A, 6B and 6C. Here, FIG. 6A is an elevation view, FIG. 6B is a plan view, and FIG. 6C is a right-side view. When a current is supplied to the terminals 12*a* and 12*b* of the winding 11, the armature 51 is attracted to the face 33 of the magnetic pole piece 3 and the face 43 of the magnetic yoke piece 4, to open the break stationary contact 7*a* and close the make stationary contact 6*a*, as shown in FIG. 6B.

Figure 7:
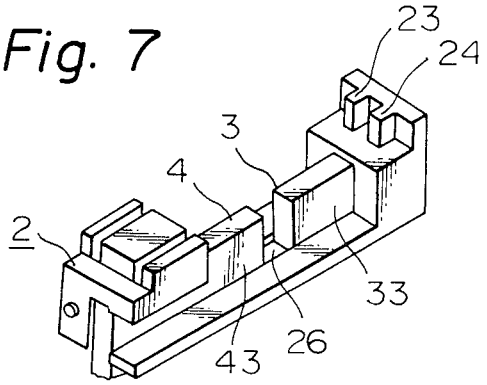
FIG. 7 is a perspective view of the base block of FIG. 5 with the magnetic pole piece and the magnetic yoke combined.

As illustrated in FIG. 7 which is a partial perspective view of FIG. 6A, since the magnetic pole piece 3 and the magnetic yoke piece 4 are fitted in the groove 26, the pole face 33 of the magnetic pole piece 3 and the hinge face 43 of the magnetic yoke 4 form a precise plane. In addition, since the base block 2 is molded, the groove 26, and the protrusions 23 and 24 can be precisely formed. Therefore, the positional relationship between the spring-type armature means 5 and the faces 33 and 43 is precisely defined, and accordingly, the positional relationship between the hinge spring 52 having the movable contacts 52*a* and 52*b* and the stationary contacts 6*a* and 7*a* is also precisely defined. As a result, the gap G (see FIG. 6B) between the contact spring 6 and the protrusion 23 generated by turning on the relay can be precisely formed, to reduce the fluctuation of the contact force of the contacts and to guarantee the margin of the contact consumption. In addition, since the dimensional tolerance of the gap G is not fluctuated, the maximum energy of the spring 6 can be reduced. Therefore, the electromagnetic force of the armature 51 can be also reduced, thereby reducing the power dissipation of the relay.

Figure 8:
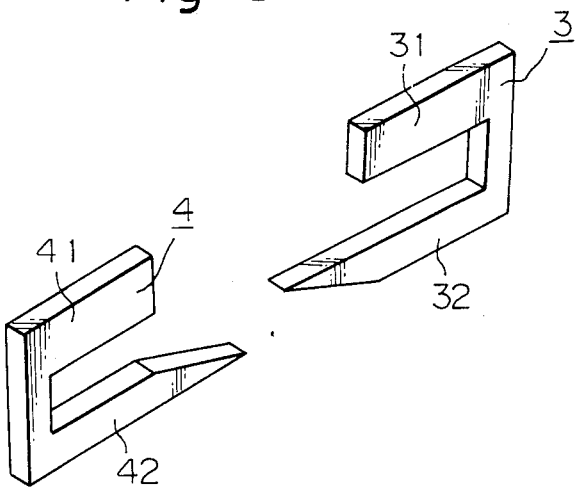
FIG. 8 is a perspective view of modifications of the magnetic pole piece and the magnetic yoke of FIG. 5.
Figure 9:
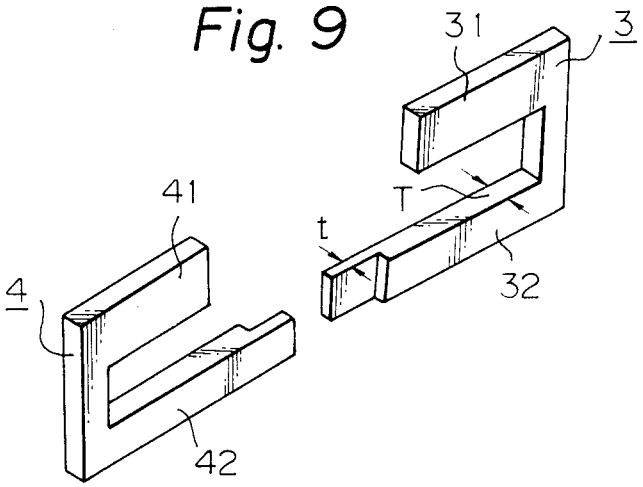
FIG. 9 is a perspective view of other modifications of the magnetic pole piece and the magnetic yoke of FIG. 5.

FIGS. 8 and 9 are modifications of the magnetic pole piece 3 and the magnetic yoke piece 4 of FIG. 5. In FIG. 8, the long tongues 32 and 42 of the magnetic pole piece 3 and the magnetic yoke piece 4 are tapered to increase the contact area therebetween, thereby reducing the magnetic reluctance therebetween. In FIG. 9, the long tongues 31 and 41 of the magnetic pole piece 3 and the magnetic yoke 4 are stepped. That is, the thickness t of the contact portions of the magnetic pole piece 3 and the magnetic yoke 4 is about half the thickness T of the other portions, thereby superimposing these two elements with each other.

In order to easily insert the magnetic pole piece 3 and the magnetic yoke piece 4 into the base block 2, it is preferable that the edges of these components be rounded.

As explained hereinbefore, according to the present invention, the molded bobbin and the molded base block can be combined by inserting the magnetic pole piece and the magnetic yoke thereinto, the assembly of the relay can be easily made, and the assembling accuracy for the contact elements can be improved. As a result, the reliability of the relay can be improved and the lifetime period can be also improved.

We claim:

1. An electromagnetic relay comprising:

a bobbin having a central hole;

a winding wound on said bobbin;

a base block fixed to said bobbin, said base block having a central hole and at least one guide groove;

a spring-type armature means fixed to said base block;

movable contact means fixed to said armature means;

stationary contact spring means secured in said guide groove;

an approximately U-shaped magnetic pole piece having long and short tongues;

an approximately U-shaped magnetic yoke piece having long and short tongues;

the long tongue of said magnetic pole piece and the long tongue of said magnetic yoke piece being opposed and connected to each other at said central hole of said bobbin;

the short tongue of said magnetic pole piece and the short tongue of said magnetic yoke piece being opposed without contact to each other at said central hole of said base block; and said armature means locating in the vicinity of a gap between the short tongues of said magnetic pole piece and said magnetic yoke piece.

2. An electromagnetic relay as set forth in claim 1, wherein said base block comprises protrusion means for securing said stationary contact spring means when said movable contact means is not in contact with said stationary contact spring means.

3. An electromagnetic relay as set forth in claim 1, wherein said spring-type armature comprises a hinge spring fixed to said base block.

4. An electromagnetic relay as set forth in claim 1, wherein the contacting faces of the long tongues of said magnetic pole piece and said magnetic yoke piece are tapered.

5. An electromagnetic relay as set forth in claim 1, wherein the contacting portions of the long tongues of said magnetic pole piece and said magnetic yoke piece are stepped.

* * * * *